US006655322B1

(12) United States Patent
Godwin et al.

(10) Patent No.: US 6,655,322 B1
(45) Date of Patent: Dec. 2, 2003

(54) BOILER WATER BLOWDOWN CONTROL SYSTEM

(75) Inventors: Douglas A. Godwin, Birmingham, AL (US); David A. Johnson, Chesterfield, VA (US)

(73) Assignee: ChemTreat, Inc., Glen Allen, VA (US)

( * ) Notice: Subject to any disclaimer, the term of this patent is extended or adjusted under 35 U.S.C. 154(b) by 0 days.

(21) Appl. No.: 10/219,318

(22) Filed: Aug. 16, 2002

(51) Int. Cl.[7] ..... F22B 37/18

(52) U.S. Cl. ..... 122/379; 122/382; 122/396; 122/403

(58) Field of Search ..... 122/379, 382, 122/396, 403

(56) References Cited

U.S. PATENT DOCUMENTS

| | | | |
|---|---|---|---|
| 3,680,531 | A | 8/1972 | Holdt |
| 3,802,398 | A | 4/1974 | Cancilla et al. |
| 3,908,605 | A | 9/1975 | Andersen |
| 4,070,992 | A | 1/1978 | Holdt |
| 4,285,302 | A | 8/1981 | Kelly |
| 4,465,026 | A | 8/1984 | Carberry |
| 4,639,718 | A | 1/1987 | Gasper |
| 4,905,721 | A | 3/1990 | Muccitelli |
| 4,938,174 | A | 7/1990 | Bennett |
| 5,041,386 | A | 8/1991 | Pierce et al. |

FOREIGN PATENT DOCUMENTS

| | | |
|---|---|---|
| EP | 340977 | 4/1989 |
| EP | 375326 | 12/1989 |

OTHER PUBLICATIONS

The Cost of Improper Water Treatment, 1997, BetzDearborn Inc.

Blower Blowdown Control, Jun. 1999.

*Primary Examiner*—Jiping Lu

(57) ABSTRACT

The present invention relates to a method for automatically maintaining the concentration of scale forming minerals in boiler water for boiler systems utilizing bimodal feedwater pumps that deliver a substantially constant feedwater flow to the boiler drum when activated. According to the present invention, the feedwater supply pump and blowdown rate control valve are synchronized to remove boiler water at a predetermined rate when the feedwater pump is activated. The present invention thereby provides a simplified and less expensive method for controlling the concentration of dissolved solids in boiler water despite variations in the steam loads and/or other boiler operation parameters.

19 Claims, 6 Drawing Sheets

BOILER WATER BLOWDOWN CONTROL SYSTEM

CROSS-REFERENCE TO RELATED APPLICATIONS

The present application does not claim the benefit of any previously filed and copending nonprovisional applications (or international applications designating the United States of America) under 35 U.S.C. §§ 120, 121 or 365(c).

STATEMENT REGARDING FEDERALLY SPONSORED RESEARCH OR DEVELOPMENT

The present invention was not developed either wholly or partially under any federally sponsored research and development program or grant.

BACKGROUND OF THE INVENTION

1. Technical Field

The present invention relates to an improved blowdown control method for preventing the formation of scale within a boiler system.

2. Description of the Related Art

Successful and efficient operation of industrial steam boiler systems requires that the various chemical constituents of boiler water be controlled in a manner that will avoid or at least minimize both the formation of mineral scale or deposits on heat exchange surfaces and the corrosion of metal surfaces within the steam boiler system. While deposition tends to involve corrosion products generated within the boiler system, scale is more commonly results from the precipitation of scale forming minerals, typically salts of calcium and/or magnesium introduced into the boiler systems with the makeup water.

Even with the best makeup water pretreatment, scale and deposition control chemistry is required to control residual amounts traces of scale forming minerals and any corrosion products formed within the boiler system.

Scale control products may be broadly classified as precipitating or non-precipitating depending on the manner in which they act to prevent scale formation. Precipitating products commonly rely on carbonate or phosphate chemistry to precipitate the hardness minerals and form a fine "mud." These fine precipitates are typically maintained in suspension through the use of one or more polymer dispersants and are removed along with a portion of the boiler water during the boiler blowdown process. Non-precipitating products, however, are more commonly based on one or more sequestrants or chelant chemistries that react with scale forming minerals to form a soluble compound. As with the precipitating products, a portion of the dissolved compound are removed along with a portion of the boiler water during the boiler blowdown process, thus preventing scale formation.

A fundamental requirement of boiler system operation is the need to maintain the concentration of all hardness or scale forming minerals and their related compounds at levels below their solubility limits to prevent scale formation. As noted above, a variety of industrial boiler water scale and deposit inhibitors are helpful in this process. However, while boiler water treatment chemicals can be used to increase boiler system tolerance to scale forming minerals, chemical treatments alone are inadequate to prevent scale formation at higher boiler water concentration levels. Therefore, in addition to boiler water treatment chemicals, a volume of the concentrated boiler water must be periodically removed from the boiler and replaced with a generally corresponding volume of less concentrated feed water during operation with a blowdown process. This is referred to as boiler blowdown.

Blowdown processes can be broadly classified as either a manual blowdown process or an automatic blowdown process. As the term implies, manual blowdown is the periodic removal of boiler water by a person, typically the boiler operator, who opens one or more valves on the boiler system to initiate the blowdown process and then closes the valve(s) to terminate the blowdown process. In connection with the manual blowdown process, the boiler operator may also run chemical or other tests on boiler water samples to determine when to initiate the blowdown and/or to determine if a sufficient quantity of the concentrated boiler water was removed. Alternatively, the boiler operator may conduct the manual blowdown according to a schedule providing prescribed intervals and/or durations for the blowdown process. This may include intermittent 'bottom blowdowns' or a blowdown rate control valve setting (continuous blowdown) to try to maintain a set point for a desired boiler water dissolved solids level.

Automatic blowdown processes, on the other hand, utilize some form of instrumentation for measuring one or more properties of the boiler system that generally correspond to the concentration of scale forming minerals in the boiler water. When the measured parameter(s), such as electrical conductivity, reach a predetermined level, the automatic blowdown system will open one or more valves to initiate the blowdown process and/or introduce feed water into the boiler system. The automatic system will typically continue the blowdown process until the measured parameter(s) indicate that the scale forming mineral concentration within the boiler water has been reduced to an acceptable level and then terminate the blowdown process.

Although the automatic blowdown processes tend to represent an improvement over manual blowdown processes, the use of such processes still tend to result in periods of the boiler operating cycle during which the boiler water is either over-concentrated, increasing the likelihood of scale formation, or under-concentrated, reducing boiler efficiency and increasing the consumption of expensive boiler treatment chemicals. Further, the sensors used for measuring the selected parameters typically require increased maintenance and cost associated with sensor replacement, calibration, and/or cleaning. Some types of sensors, in particular those used to measure conductivity, are themselves sensitive to thermal shock and eventually can lead to an underreporting of the boiler water conductivity, further delaying the blowdown cycle and increasing the potential for scale formation.

BRIEF SUMMARY OF INVENTION

The present invention provides a method for controlling boiler water concentration in boiler systems that utilize bimodal feedwater pumps that have only an ON mode and an OFF mode capable of providing feedwater to the boiler at a substantially constant flow rate in the ON mode. The present method is generally not applicable, however, to boiler systems that utilize boiler feedwater pumps that incorporate proportional feedwater flow control valves that regulate the feedwater flow rate within a given range.

In those boiler systems that utilize a bimodal boiler feedwater pump, the present invention utilizes the same signal or signals that control the boiler feedwater pump (i.e., turning it ON or OFF) to open or close a blowdown valve in synchronization with the boiler feedwater pump. When the boiler feedwater pump is turned ON, the blowdown valve is opened and boiler water is directed to a rate control valve that fixes the flow rate of the blowdown water. Using the pump curve data for the boiler feedwater pump, the flow capacity of the rate control valve is set to a predetermined percentage of the feedwater flow rate produced when the boiler feedwater pump is ON under the prevailing boiler conditions. This synchronized operation of the boiler feedwater pump and the blowdown valve assures that a fixed, proportional volume of concentrated boiler water is removed from the boiler whenever feedwater is entering the boiler and thereby maintain the scale forming minerals within a desired concentration range.

DETAILED DESCRIPTION OF THE INVENTION

Figure 1:
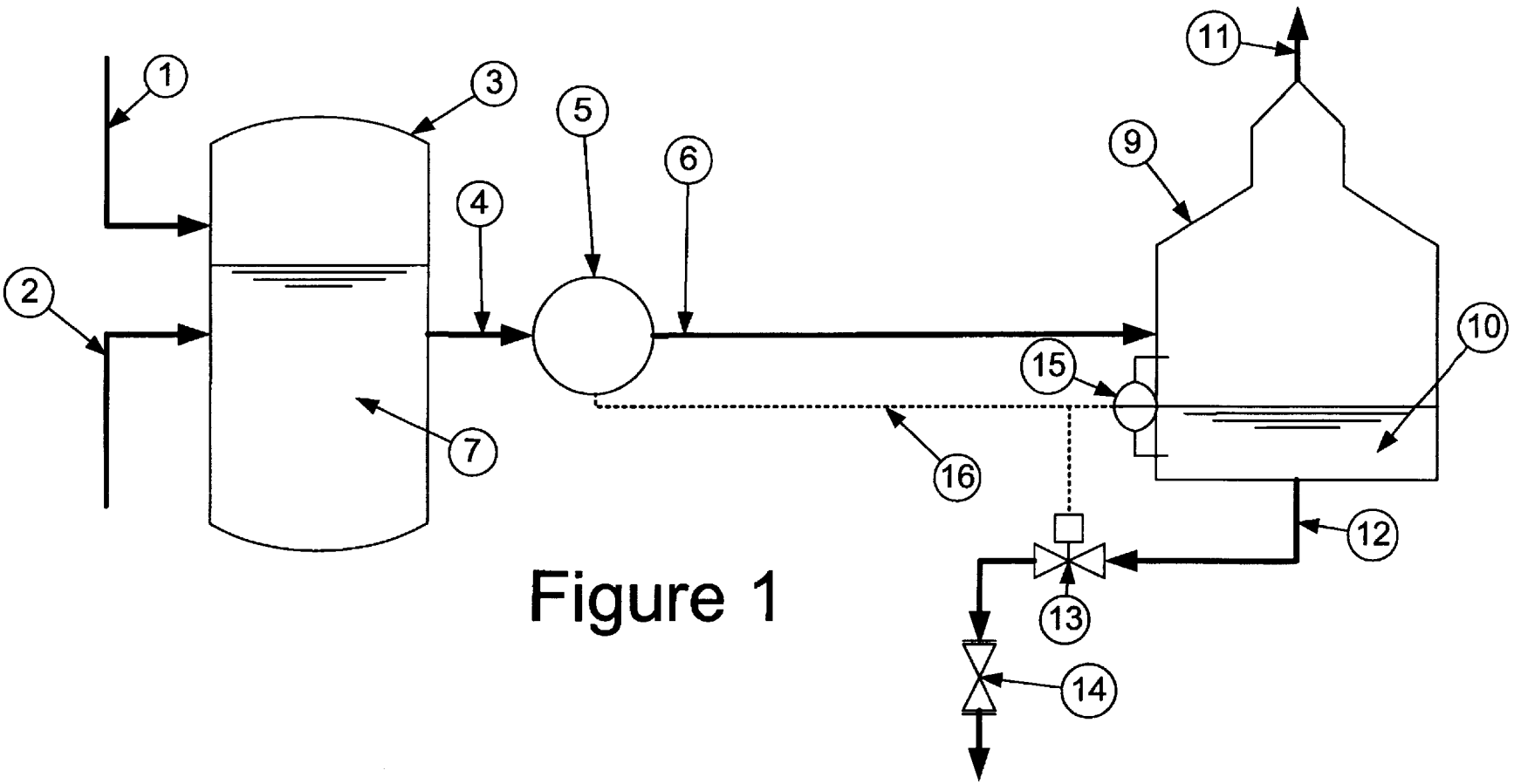
FIG. 1 is a schematic drawing illustrating the basic mechanical and electrical components of a first embodiment of the present invention.

The present invention relates to a method for automatically maintaining the concentration of scale forming minerals in boiler water for boiler systems that utilize bimodal feedwater pumps that deliver a substantially constant feedwater flow when ON. In order to achieve control, such boiler systems require variable feedwater flow regulation in which the feedwater flow is adjusted in response to changes in the steam demand and /or boiler steam drum water level. The present invention provides an accurate means for providing automated control of the concentration of dissolved solids in boiler water that is responsive to changing steam loads and/or intermittent boiler operation in which boiler water is removed at a predetermined rate equal to a selected percentage of the feedwater flow rate. The present invention provides a simple and accurate means for controlling boiler blowdown in certain types of boiler systems without the control deficiencies resulting from manually controlled blowdown, changing feedwater quality, or the concerns regarding the reliability of conductivity controller probes, the need for temperature compensation or the need for complicated instrumentation calibration procedures.

The standard terminology in the boiler and steam generation industry defines the rate of boiler blowdown as a percentage of the feedwater flow. For example, a five percent blowdown means that boiler water is systematically removed at a rate equal to five percent of the feedwater flow rate into the boiler in order to maintain an acceptable concentration of dissolved solids in the boiler water. Industry guidelines prepared and distributed by the ASME. (American Society of Mechanical Engineers) and the ABMA (American Boiler Manufacturers Association) provide recommended concentration limits for the total dissolved solids (TDS) present in boiler water for various ranges of boiler water parameters.

The ASME and ABMA guidelines, among others, are widely used by engineers and boiler operators to determine the amount of boiler water that must be periodically removed from the boiler system to maintain the TDS concentrations within the desired range. Depending on the condition of the feedwater and the boiler operating conditions, the amount of boiler water that must be removed can vary widely, typically comprising between 2 to 20 percent of the feedwater flow. The boiler water is typically removed using a blowdown process in which a valve is opened, either manually or automatically, thereby allowing a portion of the boiler water to be removed from the operating boiler.

In order for manual blowdown processes to provide acceptable TDS control a number of conditions must exist simultaneously within the boiler system. These conditions are 1) the boiler steam load is constant; 2) the feedwater quality is constant; 3) the percent condensate return is constant; and 4) the boiler operators perform regular tests on the boiler water, typically at least once per shift, to determine the proper blowdown rate settings. In the real world, however, this combination of conditions rarely, if ever, exists.

Indeed, most industrial and commercial boiler systems will typically experience variations in the steam load, feedwater quality and/or the percentage of condensate return. These variations may be the result of, for instance, ambient temperature changes that affect heating requirements, plant production rate changes, and/or different production equipment coming online or going offline. When faced with such continually changing conditions, boiler operators are constantly "chasing" the proper manual settings on blowdown control valves in their efforts to maintain the desired boiler water chemistry.

The most basic automatic blowdown systems provide for a series of automatic blowdowns conducted according to a preset schedule, with the boiler operator adjusting the schedule based on changes in the boiler system operation timed and executed. Again, however, the reliance on testing and subsequent adjustment of the blowdown schedule render such systems vulnerable to the same "chasing" problems associated with fully manual blowdown processes. More commonly, automatic blowdown systems incorporate a control module that will modulate the frequency, duration and/or volume of the blowdown process based on input from one or more detectors.

The detectors employed in such systems typically monitor the TDS in the boiler system by measuring, either continuously or intermittently, the conductivity of the boiler water. When the measured conductivity exceeds a predetermined set point, the control module will open a blowdown valve to remove a portion of the boiler water from the boiler drum. For such systems to operate properly, however, the boiler water should be cooled and flow continuously over the detector, thus increasing the complexity of the boiler system in order to provide a blowdown circulation loop and cool the blowdown before it reaches the detector. Boiler systems that do not or cannot incorporate the additional piping and equipment necessary to provide a continuous flow of cooled blowdown across the detector typically experience problems with flashing of the blowdown on the conductivity probe, affecting measurement accuracy, and thermal shocks that degrade detector integrity. Further, a boiler system utilizing such detectors must also provide for regular detector calibration intervals, increasing the maintenance expenses.

The present invention, however, is completely mechanical and thus does not depend on conductivity detectors or other instrumentation that requires regular calibration, are subject to intermittent failures, experience drifts in accuracy, or require frequent, regular operator input. As a result, the present invention reduces maintenance costs and provides energy savings by maintaining blowdown rates as a fixed percentage of feedwater flow. Further, because the blowdown stream flows only when the feedwater pump is ON, the blowdown may be passed through a feedwater heat exchanger to provide a generally consistent level of feedwater heating. As a result, the boiler system operation is both improved and simplified, providing a blowdown rate and boiler system energy balance that are substantially constant and are not subject to the fluctuations and complexity associated with automatic conductivity-controlled blowdown systems.

As illustrated in FIG. 1, a boiler system according to the present invention comprises a feedwater source 3, typically comprising both condensate return 1 and makeup water 2, containing feedwater 7 characterized by a relatively low concentration of TDS. The feedwater flows out of the feedwater source 3 through a line 4 that is connected to a feedwater pump 5. When the feedwater pump is turned ON, a substantially constant flow of feedwater is delivered through line 6 to the boiler drum 9 where the feedwater is incorporated into the boiler water 10. The boiler water 10 is then heated to generate steam which exits the boiler through line 11 for use in other equipment or operations.

The boiler drum is also provided with a sensor 15 that monitors one or more parameters within the boiler drum, preferably at least the boiler water level. When the sensor indicates that additional water is required in the boiler drum, e.g., if the water level reaches a predetermined minimum level, it generates a first control signal 16 that turns the feedwater pump ON and opens blowdown valve 13. As the feedwater pump begins to deliver feedwater to the boiler drum, a portion of the boiler water 10 flows through line 12, the blowdown valve and a rate control valve 14 that limits the blowdown flow to within a narrow predetermined percentage range of the feedwater flow. Once the boiler water level has returned to a satisfactory level, the sensor generates a second control signal that turns the feedwater pump OFF and simultaneously closes the blowdown valve. As will be appreciated, the second control signal may simply be the cessation of the first control signal.

Figure 2:
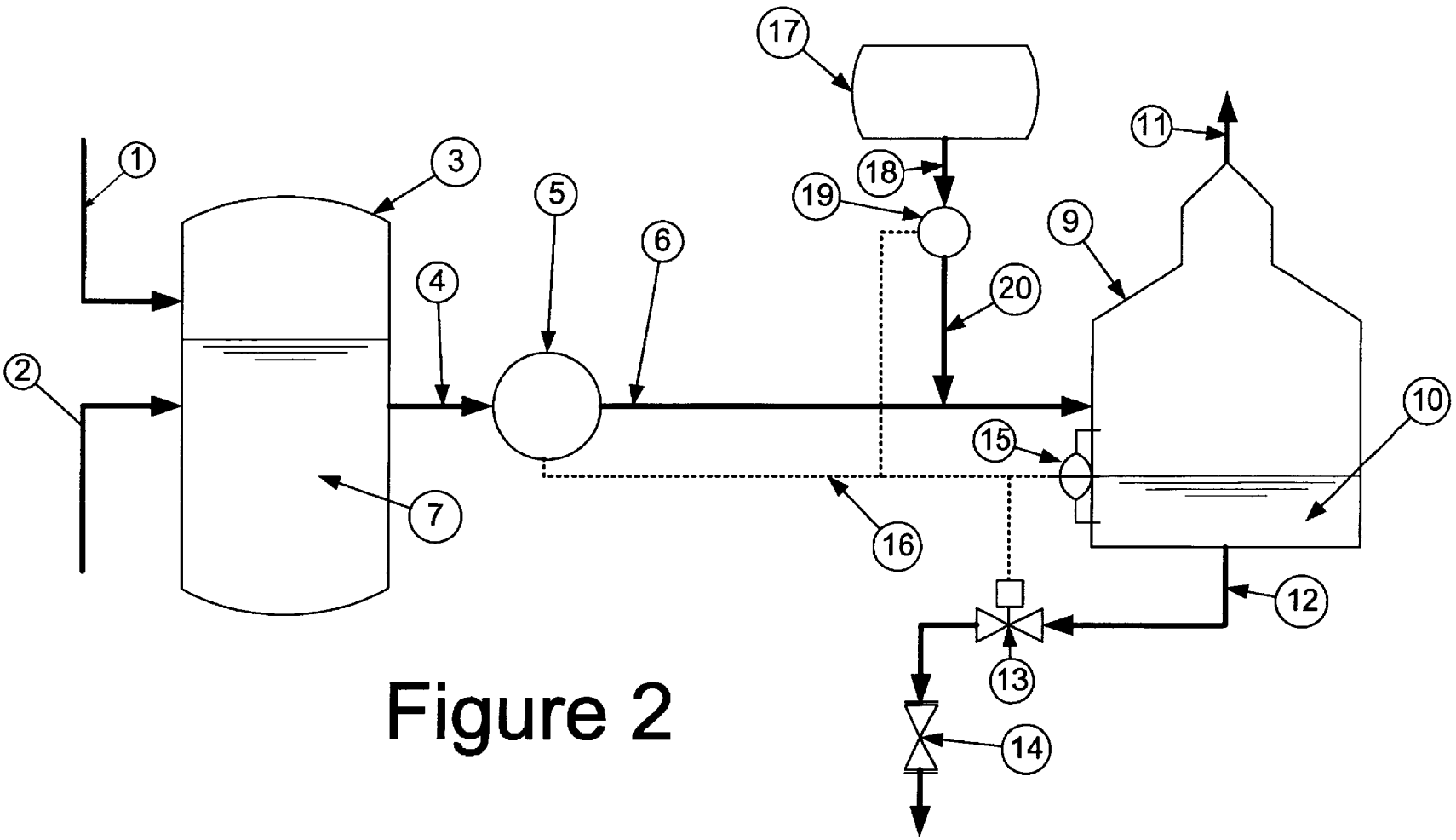
FIG. 2 is a schematic drawing illustrating the basic mechanical and electrical components of a second embodiment of the present invention.

Another embodiment of the present invention that also provides for treatment chemical feed is illustrated in FIG. 2. In addition to the basic components illustrated in FIG. 1, the second embodiment of the invention includes a treatment chemical source 17 from which a solution comprising one or more treatment chemicals is fed through a line 18 to a chemical feed pump 19. As with the first embodiment, the sensor 15 will generate a control signal 16 in response to a boiler parameter.

In the second embodiment, however, in addition to turning the feedwater pump ON and opening the blowdown valve the same control signal 16 will turn chemical feed pump 19 ON to deliver treatment chemicals to the feedwater line 6 (or directly into the boiler drum) at a predetermined rate to maintain an acceptable level of treatment chemicals in the boiler water 10. Once the boiler water level has returned to an acceptable level, the sensor will generate a control signal that simultaneously turns the feedwater pump OFF, closes the blowdown valve, and turns the chemical feed pump OFF.

Figure 3:
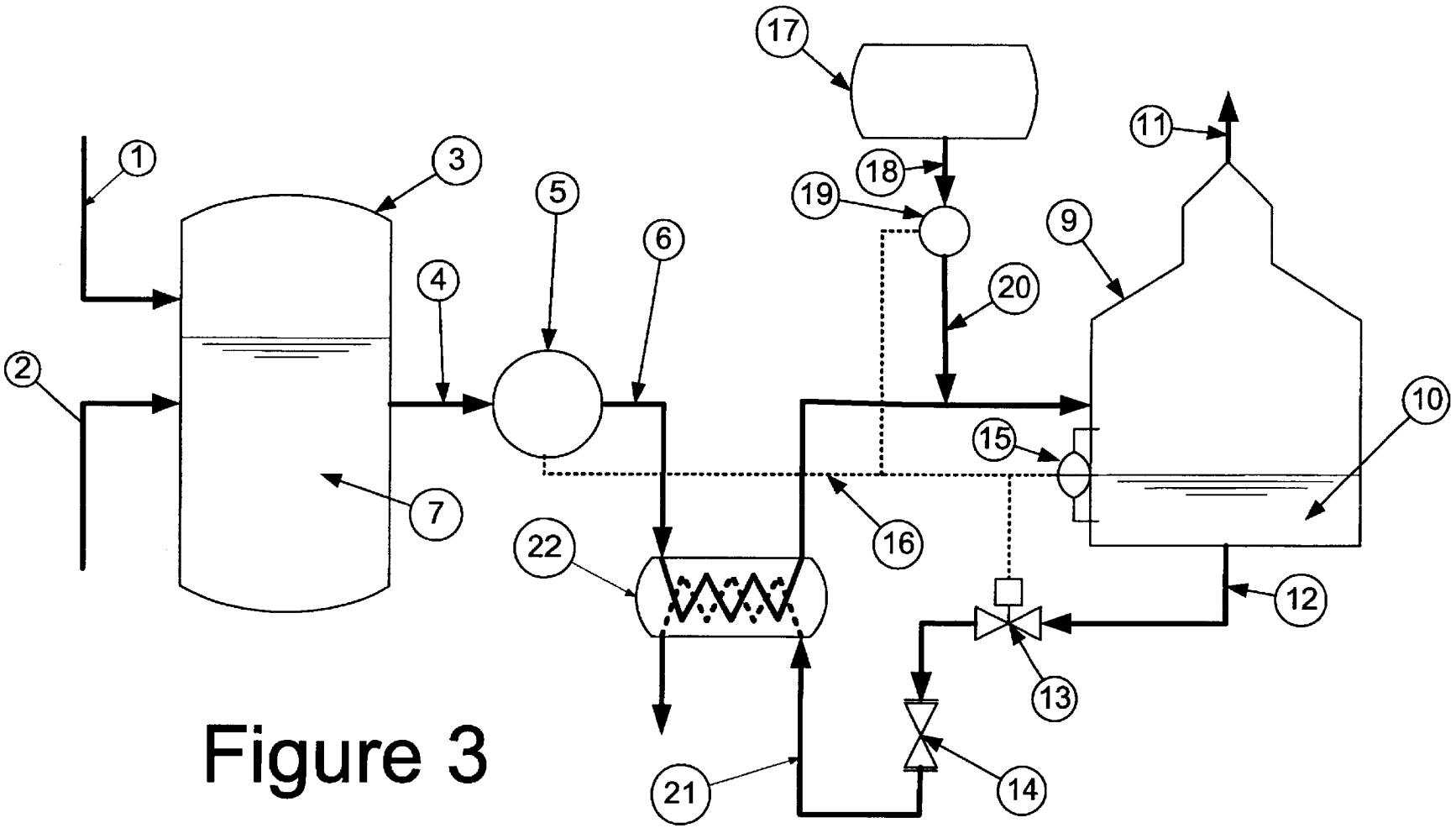
FIG. 3 is a schematic drawing illustrating the basic mechanical and electrical components of a third embodiment of the present invention.

A third embodiment of the invention is illustrated in FIG. 3. In addition to incorporating the basic components illustrated in FIGS. 1 and 2, the third embodiment of the invention includes a heat exchanger 22. This heat exchanger allows recovery of a portion of the heat energy from the blowdown stream entering through line 21 and uses that heat energy to increase the temperature of the feedwater entering through line 6 and increase the energy efficiency of the boiler system.

For example, the amount of blowdown required may be calculated by a boiler operator using the following variables:

FW, feedwater, pounds per hour (kilograms/hour);

BD, blowdown, expressed as a percentage of the feedwater;

E, evaporation, expressed as a percentage of the feedwater;

$R_{fw}$, cycles of concentration (also referred to as CoC or simply cycles) (based on the acceptable ratio of feedwater and boiler water constituents); and Steam, steam production, expressed in pounds per hour (kilograms/hr); and the following formulas:

$$R_{fw} = \frac{\text{boiler water constituent}}{\text{feedwater constituent}} \quad [1]$$

$$BD = \frac{100\%}{R_{fw}} \quad [2]$$

$$E = 100\% - BD \quad [3]$$

$$FW = \frac{\text{Steam}}{E/100} \quad [4]$$

EXAMPLE

To configure a boiler system to achieve steam production of 11,885 pounds per hour (5391 kg/hr) in a 0–300 psig (0–2.07 MPa) boiler using feedwater having 7.5 ppm silica, a boiler operator may refer to ASME guidelines for 0–300 psig (0–2.07 MPa) boilers that provide for a maximum silica concentration in the boiler water of 150 ppm. Based on the feedwater analysis and the ASME guidelines, the boiler operator can calculate the allowable cycles of concentration using formula [1] as:

$$R_{fw} = \frac{150 \text{ ppm}}{7.5 \text{ ppm}} = 20 \text{ cycles of concentration}$$

Once the cycles of concentration have been determined, the boiler operator can determine the amount of blowdown required to maintain this level of concentration using formula [2], $$BD = 100/R_{fw} = 100/20 = 5.00\% \text{ blowdown required}$$

as well as the evaporation rate and the quantity of feedwater required to maintain the boiler system using formulas [3] and [4]

$$E = 100 - 5.00 = 95\% \text{ evaporation}$$

$$FW = 11{,}885/0.95 = 12{,}510 \text{ lbs/hr (5674 kg/hr) feedwater}$$

Thus, in order to operate the boiler system to produce 11,885 lbs/hr (5391 kg/hr) of steam, the boiler operator must input feedwater into the boiler drum at a rate of 12,510 lbs/hr (5674 kg/hr) and remove the concentrated boiler water at a rate of 625 lbs/hr (283 kg/hr) through a blowdown process.

Figure 4:
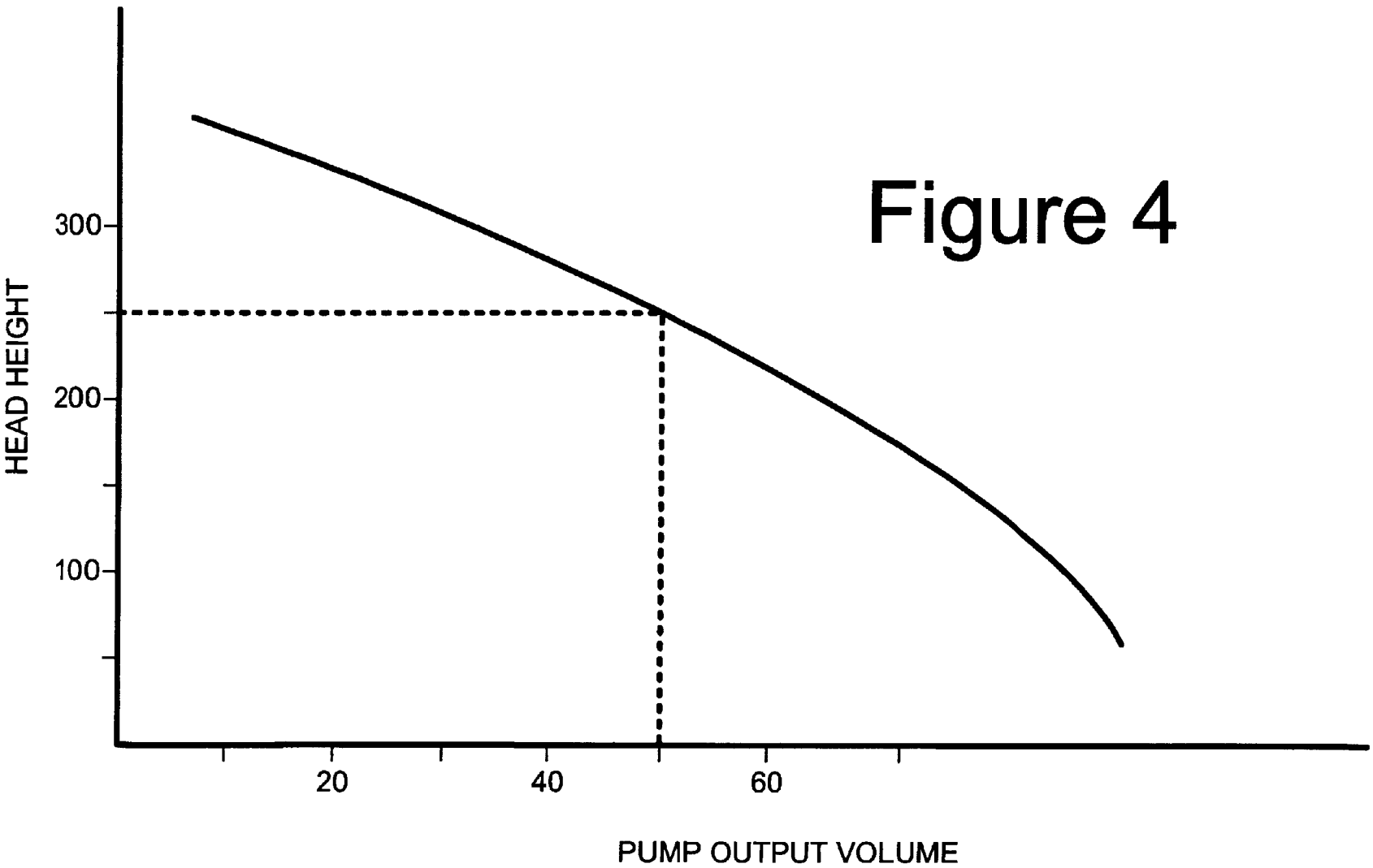
FIG. 4 is graph representing a boiler feedwater pump curve.
Figure 5:
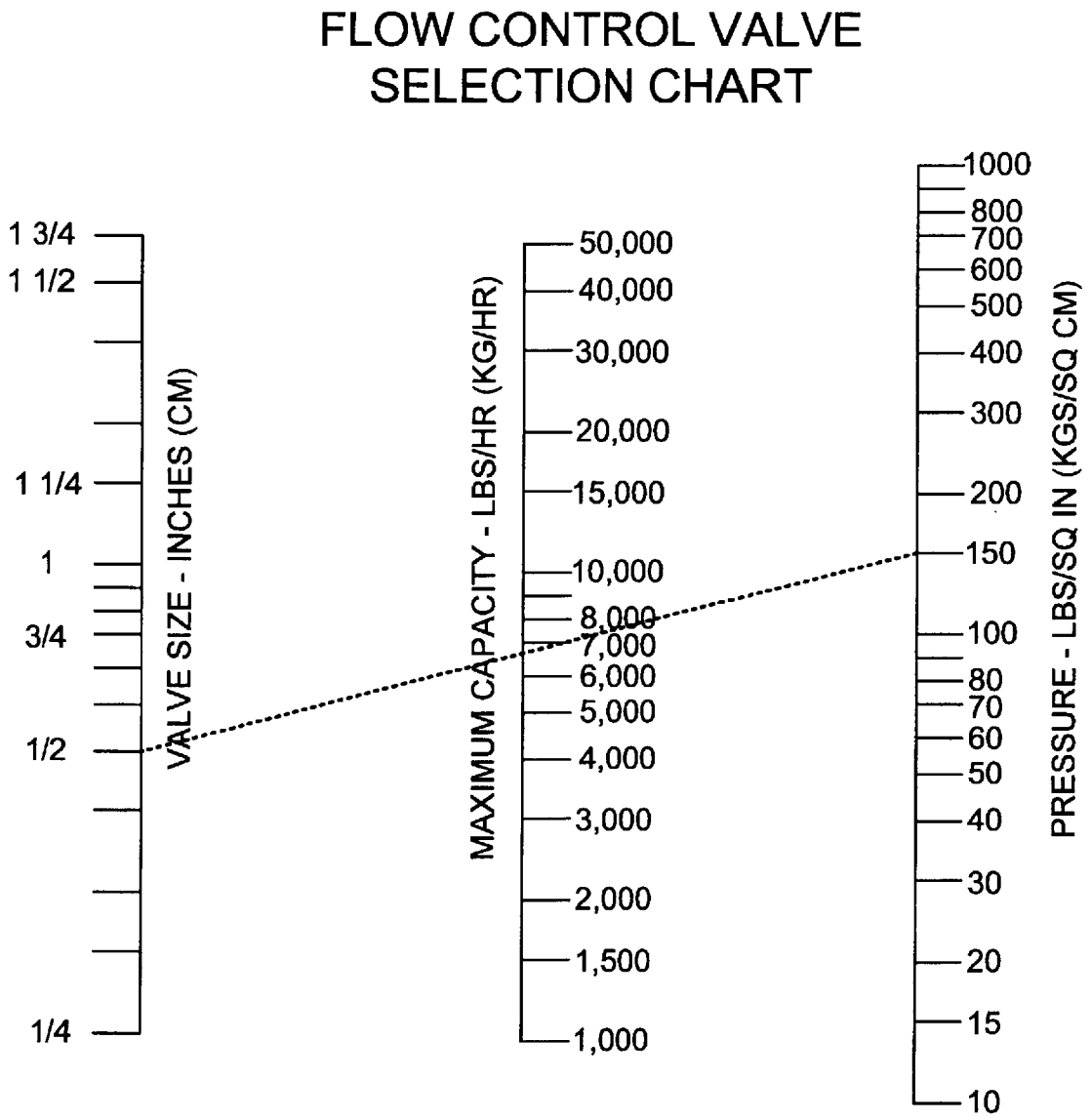
FIG. 5 is a representative a flow control valve chart.

To implement the boiler system described in the Example, if the boiler system is configured so that the nominal head at the feedwater pump is 250 feet (76.2 meters), the boiler operator or engineer will consult the pump performance date for the feedwater pump, i.e., the pump curve illustrated in FIG. 4, to determine the feedwater pump output under those operating conditions, i.e., 50 gallons/minute (189.2 liters/minute). In order to achieve the desired 5% blowdown, the rate control valve will, in turn, need to be configured, using a flow control chart as illustrated in FIG. 5, to pass 2.5 gallons/minute (9.46 liters/minute) at its nominal operating pressure.

Accordingly, once the boiler operator has determined the necessary blowdown rate, the blowdown rate flow control valve, preferably an in-line orifice, is sized to provide a maximum upper limit on flow that will produce the desired blowdown rate. It is preferred that the actual rate flow control valve be selected so that the desired maximum upper limit on blowdown flow is approximately 50% of the control valve capacity at the operating pressure. The selection of the rate control valve is commonly guided by a valve selection chart, e.g., FIG. 5, that a boiler operator or engineer can use to determine the necessary valve sizing based on the boiler system pressure and the maximum flowrate desired. Although not preferred, it is certainly possible to use a fixed geometry orifice as the rate flow control valve to produce the blowdown rate, but any flow rate adjustments would require an adjustment of the operating pressure and may be more difficult to implement. Once set, the blowdown rate control valve will provide a fixed, repetitive blowdown flow as long as the feedwater pump is running. By setting the blowdown flow rate at the desired percentage of the feedwater feed rate, a boiler system according to the present invention maintains the desired cycles of concentration in the boiler system. Once the boiler system start up has been completed, the feedwater and boiler water chemical constituents may be checked again to confirm and fine-tune the blowdown valve rate setting.

As a result of the parallel connections made between the feedwater pump electrical circuit and the blowdown valve, a boiler system according to the present invention will operate automatically and provide acceptable blowdown control over a range of boiler system variations. As will be appreciated, the selection of the particular pumps, valves, solenoids, sensors, and control modules necessary to configure a particular boiler system to operate in accord with the present invention will be within the ability of boiler operators and other plant maintenance personnel. A four-v port TASCO® bronze Flocontrol® valve has been found to be particularly well suited for use in implementing the present invention in existing boiler systems.

Figure 6:
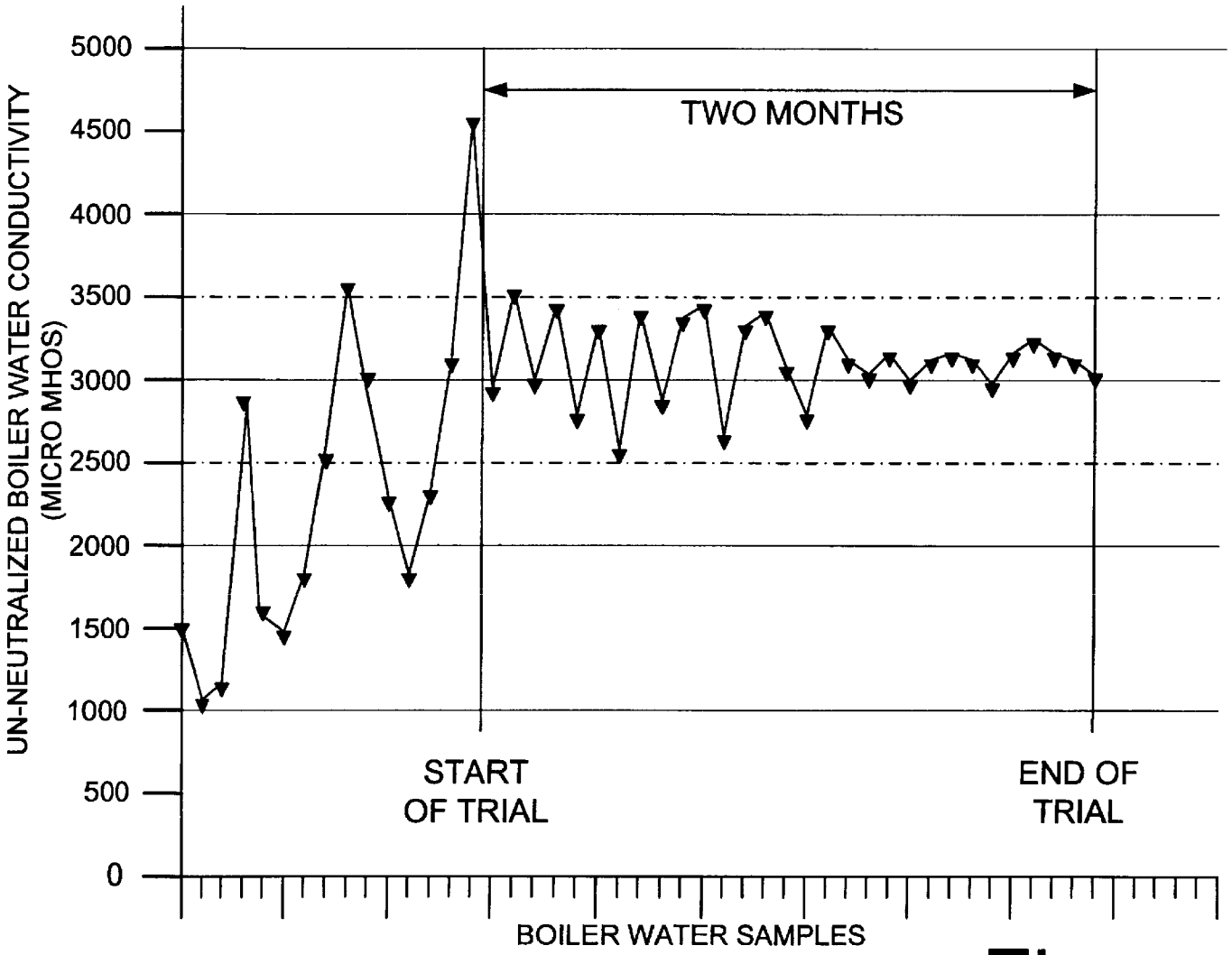
FIG. 6 is a graph demonstrating the superior control achieved by the present. invention over a prior art manual blowdown method.

An experimental two-month trial of a blowdown control system according to the present invention was conducted on an industrial gas-fired boiler system to confirm the ability of the present invention to provide effective control of scale forming minerals. As reflected in the un-neutralized conductivity data provided in FIG. 6, the present invention afforded significantly improved control of the boiler water conductivity, reducing instances of excessive blowdown, i.e., conductivity less than 2500 $\mu$mhos, and insufficient blowdown, i.e., conductivity greater than 3500 $\mu$mhos, thereby reducing the risk of scale formation while simultaneously improving boiler efficiency, by coordinating the feedwater and blowdown processes.

The improved control of the boiler water concentration will also allow the boiler system to be operated at higher cycles of concentration, increasing energy savings, reducing expenses associated with makeup water and disposal of blowdown water. As an example, for a gas-fired boiler system operating configured to produce steam at a rate of 5175 lbs/hr (2347 kg/hr) with 60% condensate return at a boiler pressure of 125 psig (0.86 MPa) and a fuel cost of \$8.50/$10^6$ btu, (\$8.06/1000 Mjoule) shifting from 15 cycles of concentration to 35 cycles of concentration with blowdown control according to the present invention could produce annual savings on the order of \$6000 in fuel costs alone. When the decreased maintenance and expense of the present invention compared to a conventional conductivity-based automated system are considered, the boiler operation savings will only increase.

The description and illustrations of the present invention provided above are merely exemplary in nature and it is anticipated that those of ordinary skill in the art will appreciate that many variations or rearrangements of the specific apparatus described are possible without departing from the spirit and scope of the invention in which the blowdown and feedwater flows are synchronized and proportional regardless of changes in other system variables.

We claim:

1. A method for controlling a boiler system having a boiler and a feed water assembly arranged and configured to deliver feed water having a known feed water composition to the boiler at a substantially constant feed water rate when activated comprising:

determining a target blowdown as a percentage of the feed water rate;

setting a blowdown assembly to remove boiler water from the boiler at a substantially fixed blowdown flow rate when activated, the blowdown flow rate being selected to achieve the target blowdown;

monitoring a first boiler system parameter;

activating in a substantially simultaneous manner the feed water assembly and the blowdown assembly at a first predetermined value of the parameter; and deactivating in a substantially simultaneous manner the feed water assembly and the blowdown assembly at a second predetermined value of the parameter.

2. A method for controlling a boiler system according to claim 1, wherein the monitored boiler system parameter is boiler water level;

the first predetermined value is a low boiler water level limit and the second predetermined value is a high boiler water level limit.

3. A method for controlling a boiler system according to claim 1, wherein the monitored boiler system parameter is boiler steam pressure or boiler water level.

4. A method for controlling a boiler system according to claim 3, wherein activating the feed water assembly and the blowdown assembly includes transmitting an activation signal when the monitored boiler system parameter reaches the first predetermined value and deactivating the feed water assembly and the blowdown assembly includes transmitting a deactivation signal or terminating the transmission of the activation signal when the monitored boiler system parameter reaches the second predetermined value.

5. A method for controlling a boiler system according to claim 1, further comprising:

activating a treatment chemical feed assembly at the first predetermined value of the monitored boiler parameter for providing one or more treatment chemicals to the boiler at a substantially constant treatment chemical feed rate, the one or more treatment chemicals being selected from a group consisting of corrosion inhibiters, trace elements, rust preventives, oxygen scavengers, pH controllers, solubilizing agents, chelating agents, scale controllers and dispersion agents; and deactivating the treatment chemical feed assembly at the second predetermined value of the monitored boiler parameter.

6. A method for controlling a boiler system according to claim 5, wherein the treatment chemicals are introduced into the feed water before it enters the boiler.

7. A method for controlling a boiler system according to claim 5, wherein the treatment chemicals are introduced into the boiler water.

8. A method for controlling a boiler system according to claim 1, wherein the target blowdown is within the range of percentages provided by the American Society of Mechanical Engineers (ASME) Boiler Water Standards Guidelines based on the feed water composition.

9. A method for controlling a boiler system according to claim 1, wherein activating the blowdown assembly includes opening a control valve, thereby allowing boiler water to flow through a rate control device sized and configured to pass the boiler water at the substantially fixed blowdown flow rate; and deactivating the blowdown assembly includes closing the control valve, thereby terminating the flow of boiler water through the rate control device.

10. A boiler control system comprising:

a boiler arranged and configured to contain a variable volume of boiler water;

a feed water source;

a feed water assembly, the feed water assembly arranged and configured to supply feed water from the feed water source to the boiler at a predetermined and substantially fixed feed water rate when activated and to supply substantially no feed water to the boiler when deactivated; and a blowdown assembly, the blowdown assembly arranged and configured to remove boiler water from the boiler at a predetermined and substantially fixed blowdown flow rate when activated and remove substantially no boiler water from the boiler when deactivated; and a blowdown controller arranged and configured to activate the feed water assembly and the blowdown assembly in a substantially simultaneous manner in response to a first predetermnined value of a boiler system parameter and to deactivate the feed water assembly and the blowdown assembly in a substantially simultaneous manner in response to a second predetermined value of the boiler system parameter;

wherein the blowdown flow rate is a substantially constant percentage of the feed water rate.

11. A boiler control system according to claim 10, wherein the boiler system parameter is selected from a group consisting of boiler steam pressure and boiler water level.

12. A boiler control system according to claim 10, further comprising:

a treatment chemical source for maintaining one or more treatment chemicals selected from a group consisting of corrosion inhibiters, tracer elements, rust preventives, oxygen scavengers, pH controllers, solubilizing agents, chelating agents, scale controllers or dispersion agents; and a treatment chemical feed assembly arranged and configured to supply the one or more treatment chemicals from the treatment chemical source to water within the boiler system at a predetermined and substantially fixed treatment chemical feed rate;

wherein the blowdown controller is arranged and configured to activate the treatment chemical feed assembly and the feed water assembly in a substantially simultaneous manner in response to a first predetermined value of a boiler system parameter and to deactivate the treatment chemical feed assembly and the feed water assembly in a substantially simultaneous manner in response to a second predetermined value of the boiler system parameter.

13. A boiler control system according to claim 12, wherein the treatment chemical feed assembly comprises a treatment chemical feed pump arranged and configured to begin supplying one or more treatment chemicals at a predetermined and substantially constant chemical feed rate when activated by the blowdown controller and to supply substantially no treatment chemicals when deactivated.

14. A boiler control system according to claim 12, wherein the treatment chemical feed assembly comprises an operable control valve and rate control device wherein the rate control device is sized and configured to provide a predetermined and substantially constant chemical feed rate and the operable control valve is opened when the treatment chemical feed assembly is activated, thereby allowing the one or more treatment chemicals to flow through the rate control device at the predetermined and substantially constant chemical feed rate.

15. A method of operating a boiler system:

maintaining a boiler water volume within a boiler within a predetermined volume range by adding feed water to the boiler, the feed water being added to the boiler at a predetermined and substantially constant feed water rate during a feed water cycle; and removing boiler water from the boiler during the feed water cycle at a predetermined and substantially constant blowdown rate, wherein the blowdown rate is a predetermined and substantially fixed percentage of the feed water rate.

16. A method of operating a boiler system according to claim 15, wherein maintaining the boiler water volume includes monitoring a boiler water level within the boiler;

initiating the feed cycle when the boiler water level reaches a predetermined low value;

terminating the feed cycle when the boiler water level reaches a predetermined high level.

17. A method of operating a boiler system according to claim 15, wherein maintaining the boiler water volume includes monitoring a boiler steam pressure;

initiating the feed cycle when the boiler steam pressure reaches a first predetermined value;

terminating the feed cycle when the boiler steam pressure reaches a second predetermined value.

18. A method of operating a boiler system according to claim 15:

wherein initiating the feed water cycle includes activating a feed water pump to supply feed water to the boiler, the feed water pump operating according to a feed water pump curve whereby the feed water rate may be determined; and activating a blowdown assembly to remove boiler water from the boiler system through a substantially fixed orifice provided in a flow control device, the orifice being sized to achieve the blowdown rate;

wherein the feed water pump and the blowdown assembly are both activated substantially simultaneously; and terminating the feed water cycle includes deactivating the feed water pump to terminate the supply of feed water to the boiler; and deactivating the blowdown assembly to terminate the removal of boiler water from the boiler system;

wherein the feed water pump and the blowdown assembly are both deactivated substantially simultaneously.

19. A method of operating a boiler system according to claim 18, wherein the activation of the feed water pump and the blowdown assembly are unrelated to any measurement of boiler water conductivity; and wherein the deactivation of the feed water pump and the blowdown assembly are unrelated to any measurement of boiler water conductivity.

* * * * *